US007667576B2

(12) United States Patent
Chan et al.

(10) Patent No.: US 7,667,576 B2
(45) Date of Patent: Feb. 23, 2010

(54) METHOD OF TRANSMITTING SIGNALS VIA REINFORCED STEEL BAR

(75) Inventors: Kam-tong Chan, Hong Kong (CN); Martin H. L. Chow, Hong Kong (CN); Alexander Ping-kong Wai, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 325 days.

(21) Appl. No.: 11/878,175

(22) Filed: Jul. 23, 2007

(65) Prior Publication Data

US 2009/0027174 A1 Jan. 29, 2009

(51) Int. Cl.
*G08B 9/00* (2006.01)

(52) U.S. Cl. ..... 340/286.02; 52/110

(58) Field of Classification Search ..... 340/286.02, 340/539.26, 539.14, 531; 324/67; 52/1, 52/40, 110, 848

See application file for complete search history.

(56) References Cited

U.S. PATENT DOCUMENTS

| | | | | | |
|---|---|---|---|---|---|
| 3,768,016 | A | * | 10/1973 | Townsend et al. | 52/187 |
| 4,229,613 | A | * | 10/1980 | Braun | 174/47 |
| 5,593,744 | A | * | 1/1997 | Van Vechten et al. | 428/34.4 |
| 5,673,395 | A | | 9/1997 | Kawakita | |
| 6,201,687 | B1 | | 3/2001 | Murray | |
| 6,226,933 | B1 | * | 5/2001 | Nelson et al. | 52/101 |
| 6,358,397 | B1 | * | 3/2002 | Lyublinski | 205/734 |
| 6,958,704 | B2 | * | 10/2005 | Vinegar et al. | 340/854.4 |
| 7,114,561 | B2 | * | 10/2006 | Vinegar et al. | 340/854.4 |
| 2003/0097806 | A1 | * | 5/2003 | Brown | 52/263 |

* cited by examiner

*Primary Examiner*—John A Tweel, Jr.

(57) ABSTRACT

The present invention teaches methods and systems for transmitting signals in a building utilizing the reinforced steel bar structure in the building. The methods and systems allow the transmission and receipt of signals in residences and offices in older buildings while avoiding system reconfiguration, high cost cabling, and over-invasive installation.

9 Claims, 5 Drawing Sheets

Coil A&B Result (5-25 MHz)

Coil A&B Result (10-100 MHz)

Coil A&B Result (5-25 MHz)

Coil A&B Result (10-100 MHz)

Coil A&B Result (5-25 MHz)

Coil A&B Result (10-100 MHz)

METHOD OF TRANSMITTING SIGNALS VIA REINFORCED STEEL BAR

BACKGROUND

Intelligent building, smart home, and home networking are hot topics in building industry. These systems rely on a physical layer to transmit signal. Wire and wireless physical layers are commonly used. However, both layers have their limitations and associate problems especially in old buildings.

Wireless network is free in cabling, but interference and security are the big concern. Radio spectrum is a national asset in most of the country. In order to prevent interference, most of the countries legislate a series of ordinance and regulation to govern the use of atmosphere in signal transmission. Many wireless systems are using the same unlicensed band to transmit signals. Interference is unavoidable and data security is also a big concern in wireless systems. Eavesdropping is very easy in wireless networks. The attacker can easily eavesdrop on a signal outside a guarded building and decrypt the data out.

Wired network provides higher security and reliable in signal transmission but inflexibility in system reconfiguration and higher cost on cabling and associated builder work. In more than 20 year old public rental housing, there is usually no spare cable containment for future cabling. The cost for one data outlet in new building is about HK$278. For example, a new residential building with 480 flats, the cost on ancillary systems is around HK$2,015,280. In an existing old building, the cost on adding a new network is even several times higher than new building because of associated builder work such as concrete chasing.

In view of the limitations of the traditional data transmission media, an alternative way to transmit data within a building with lower cost, less nuisance to occupants in old buildings and higher data security is needed.

It is an object of the present system to overcome the disadvantages and problems in the prior art.

DESCRIPTION

The present invention proposes to utilize the existing structure of a building, specifically its reinforced steel structure, for the transfer of signals throughout the building.

The present invention further proposes to incorporate magnetic flux theory into connected reinforced steel bars for signal transfer.

The present invention proposes its system and methods in order to allow the delivery and transfer of signals, such as telephone, SMATV, security, and broadband network, to a building. Because of the present invention, additional conduct would not be required in the transfer of signal. Thus, no additional cost is required for cable containment and cabling, there is no need to break significant amount of concrete for installation purpose, and nuisance to existing tenants is minimized.

These and other features, aspects, and advantages of the apparatus and methods of the present invention will become better understood from the following description, appended claims, and accompanying drawings where:

Figure 4A:
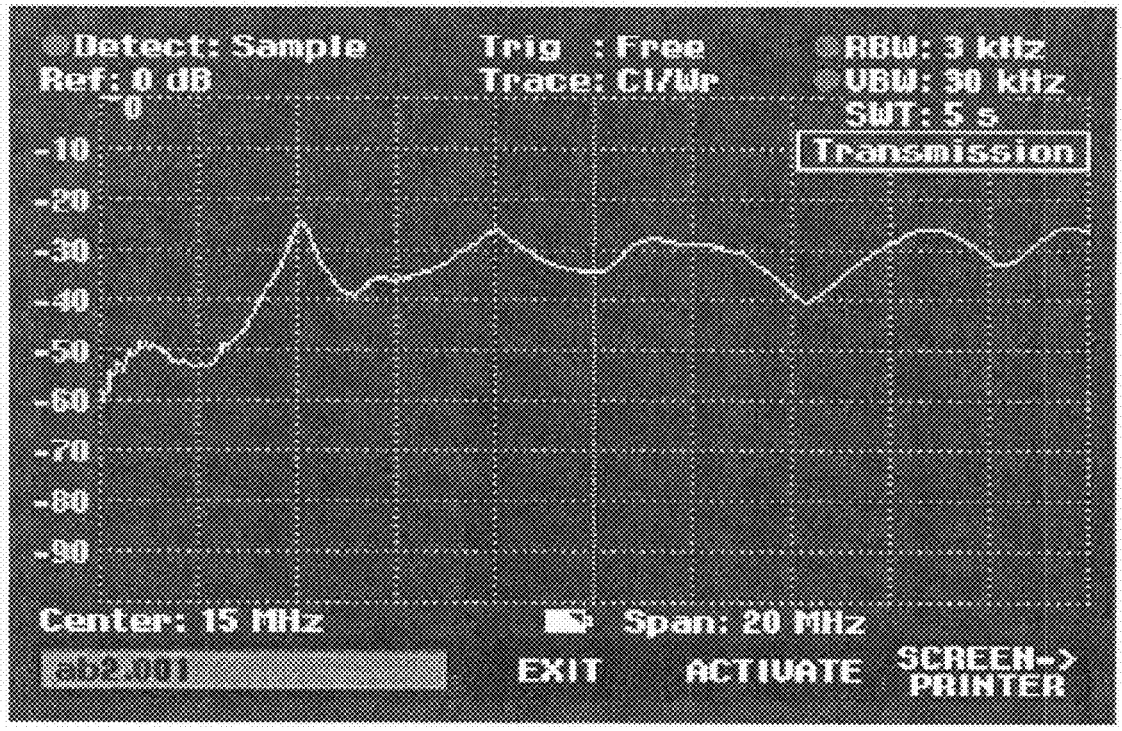
Figure 4B:
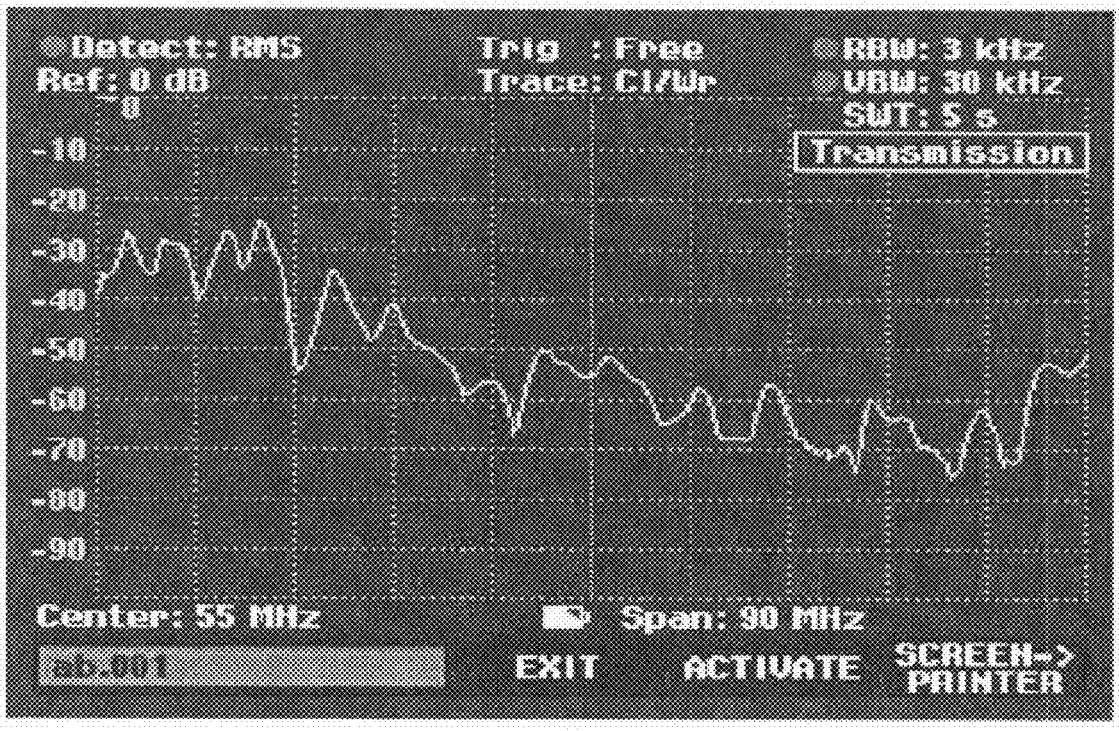
Figure 5A:
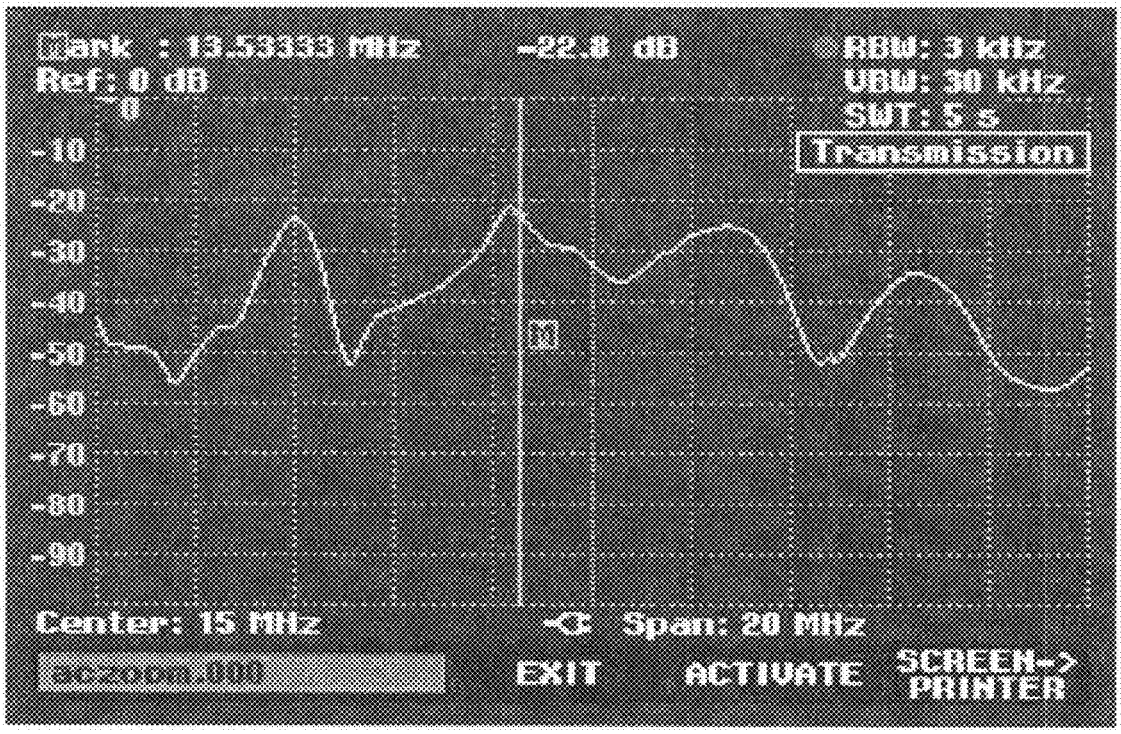
Figure 5B:
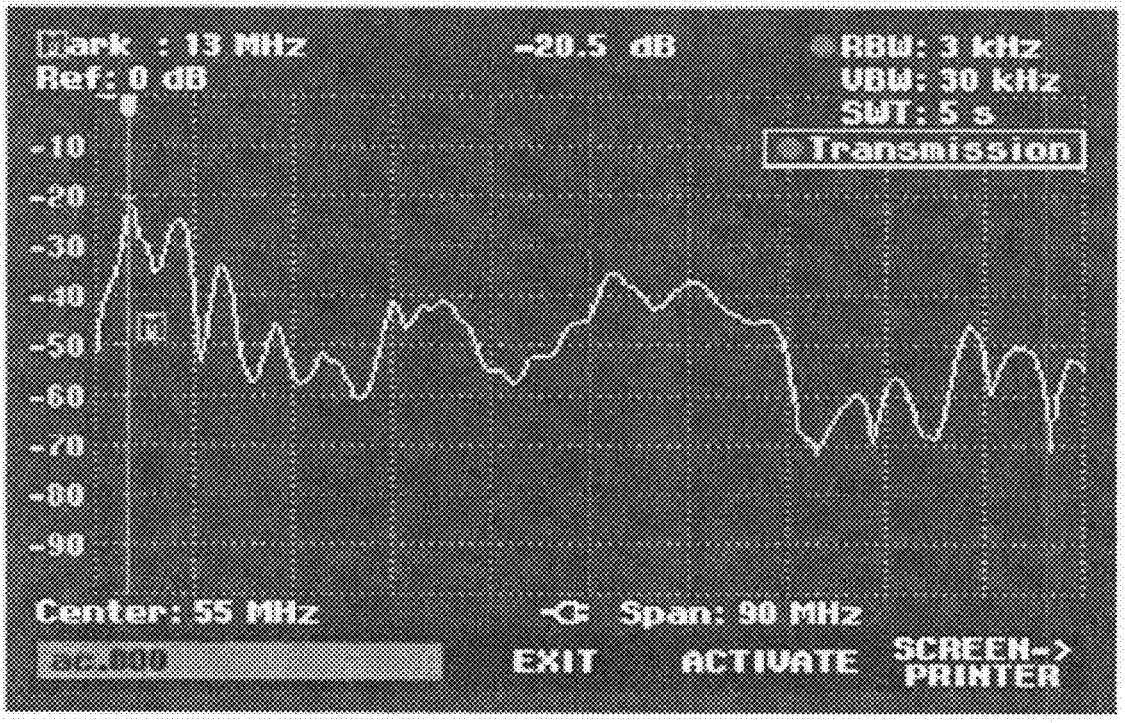
Figure 6A:
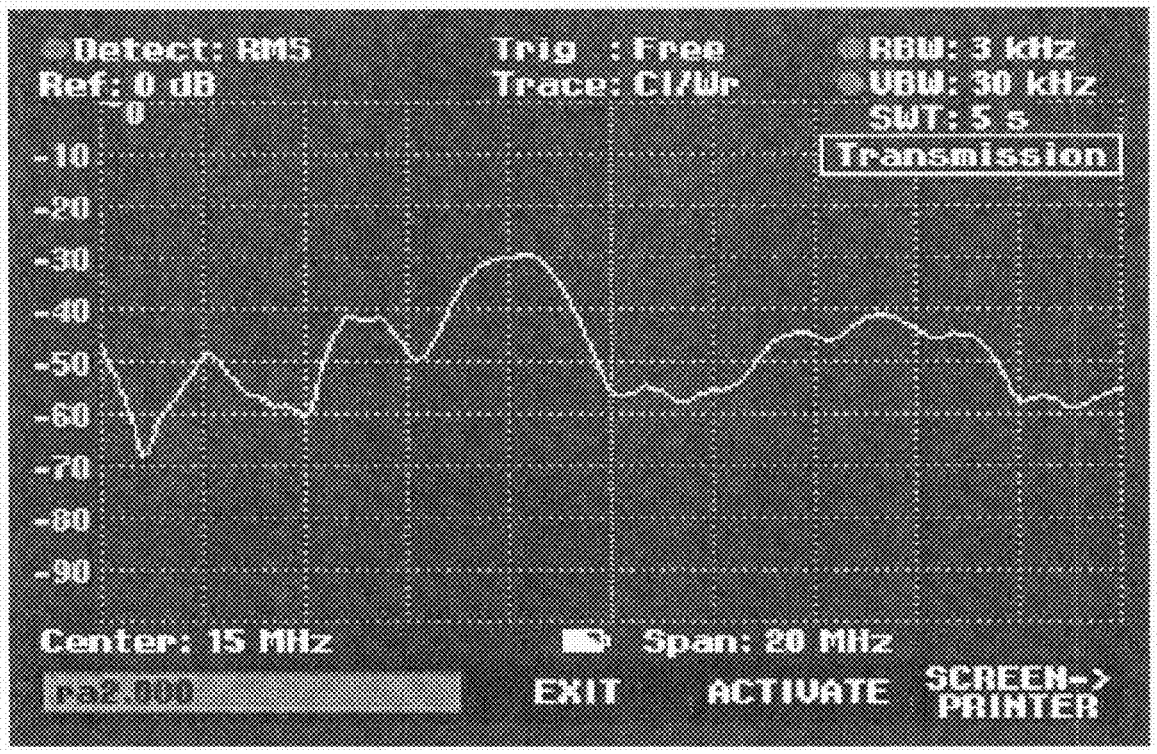
Figure 6B:
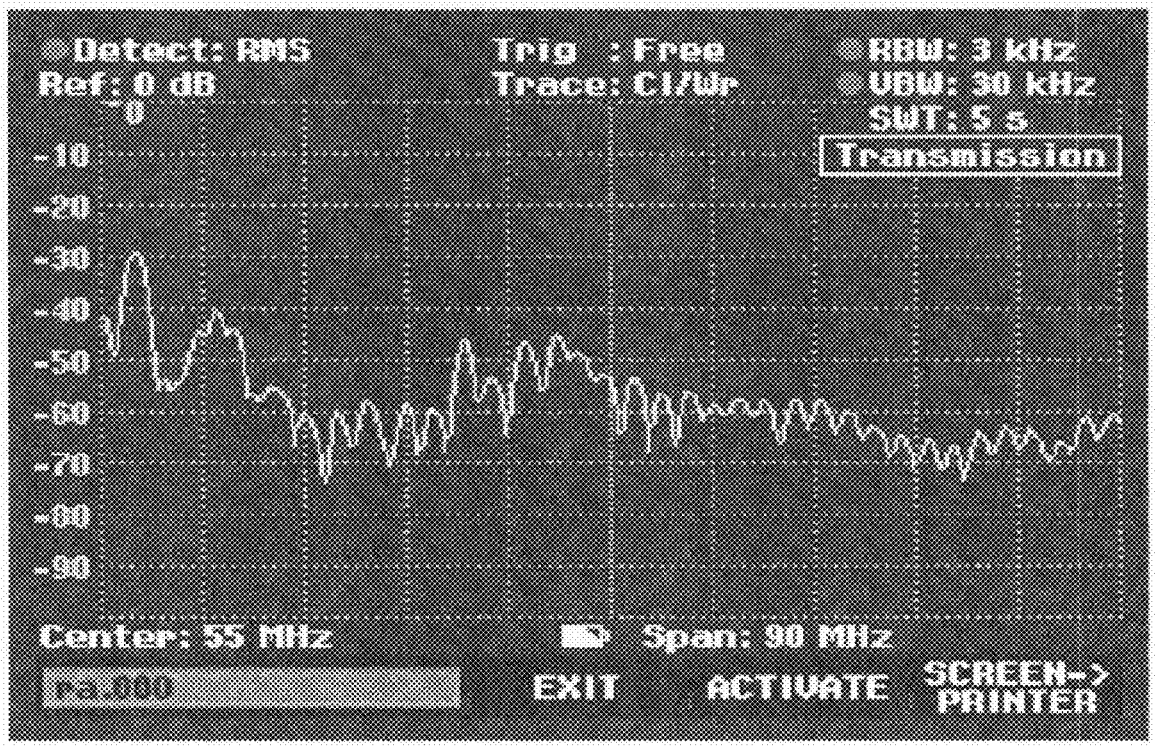

FIG. 4-6, in reference to the Example, shows the signal transfer results between different floors of the building.

The following description of certain exemplary embodiment(s) is merely exemplary in nature and is in no way intended to limit the invention, its application, or uses. Throughout this description, the term "reinforced steel bar" refers to a steel bar that is usually used to reinforce concrete or masonry.

Now, to FIGS. 1-6. Whereas FIGS. 1-6 are presented separately, they, in totale, represent the present invention. Unless otherwise noted, the FIGs refer back to and rely upon one another.

Figure 1:
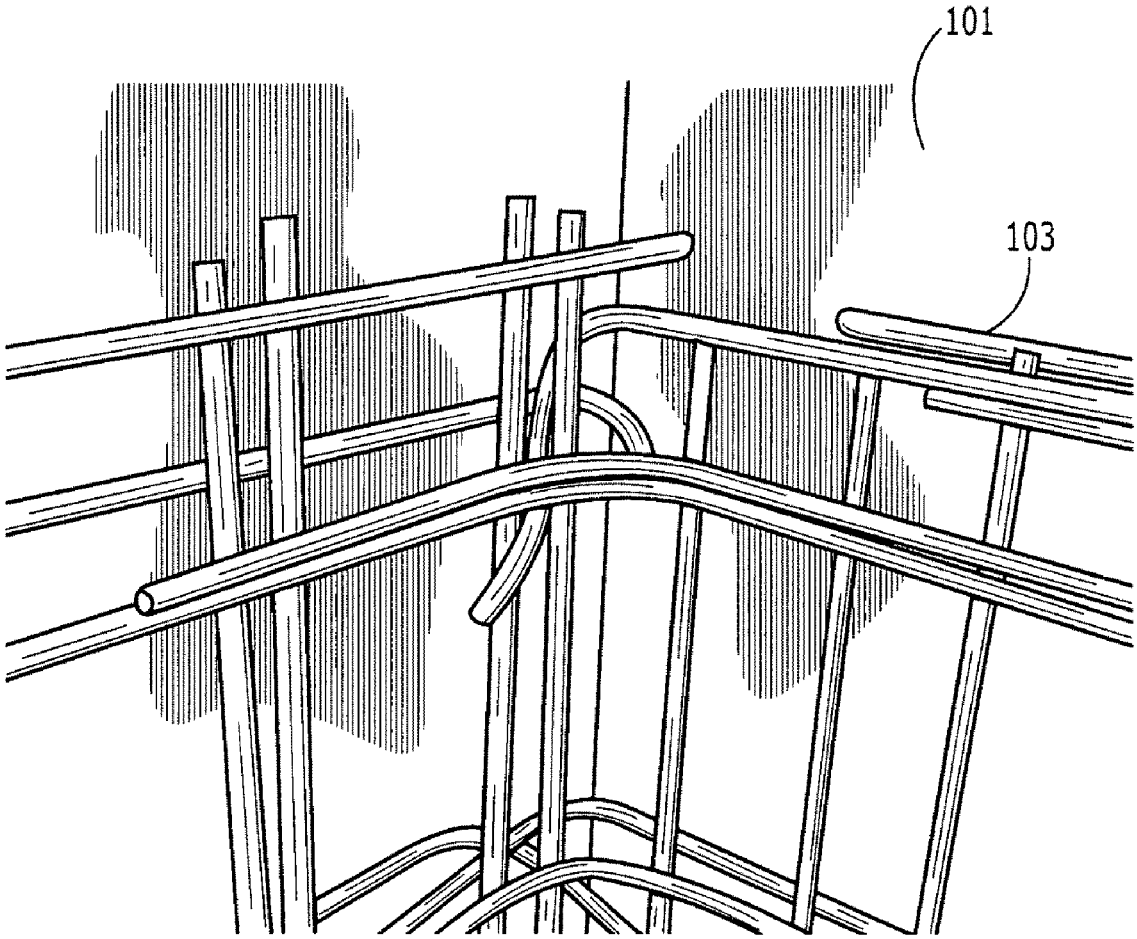
FIG. 1 shows a steel bar structure typically found in reinforced concrete buildings.

FIG. 1 is an example of reinforced steel bar structure present in many buildings. The steel bars 103 are usually wired together prior to reinforcing a concrete structure 101, such as a concrete wall. The type of steel can include plain carbon steel, high strength low alloy steel, and tool steel. As shown, the bars 103 are usually lapped one on the other in a cross fashion. The various bars are connected to one another by steel wires at the cross points. In usual circumstances, the steel bars 103 in older buildings are cast iron. In newer buildings, the bars are composites, containing steel, carbon, magnese, and other metals. The bars 103 can also be coated with anti-rust castings.

The present invention provides a system of methods, utilizing the reinforced steel bar structure present in many building structures, for delivering and transmitting signals through the signals to be delivered and transmitted include data, information, voice, content, video, graphic, internet access, and music.

Figure 2:
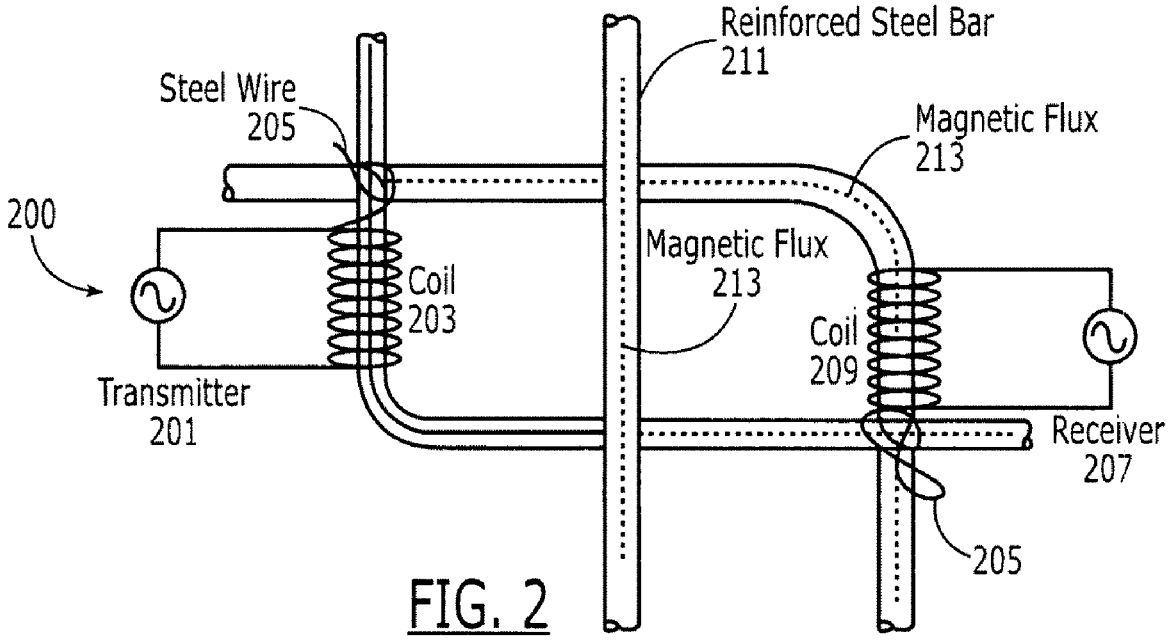
FIG. 2 shows the system made in accordance with the present invention.

FIG. 2 is an embodiment of a system of the present invention, wherein a steel structure is utilized to deliver and transmit signals throughout the building. The system 200 in general comprises a transmitter 201, receiver 207, and reinforced steel bars 211 to provide a magnetic flux-like effect through the steel structure of the building.

A transmitter 201 is connected to one reinforced steel bar 211 through windings. The windings can be any suitable number, however as an example the windings have 200 turns. The windings create a coil structure steel bar 203. The transmitter 201, on its other side, can be connected to a signal sourcing means (not shown), such as a central station, modem, a supply line, a fiber optic line, etc. The signal collecting means preferably receives a signal from a source such as a work station, modem, and the like. Prior to connecting to the steel bar 211, the signal following delivery to the transmitter 201 may be "stepped up" or amplified. In this way, the signal is strong enough to be sufficiently transferred through the building structure's reinforced steel bars 211. Prior to attachment to the steel bar 211, other electronic components may also be used to affect the signal, such as modem, filters, rectifiers, capacitors, and the like. Steel wire 205 is used throughout the steel bar structure to ensure the steel bars stay statically positional.

One or more second coils 209 connected to a receiver 207 are positioned along the reinforced steel bar of the building structure at any locations. The second coils 209 may have an equal number of turns to the transmitter coils 203, or may have a number of turns to "step down" or "step up" the signal transmitted along the steel bar 211. The second coil 209 and receiver 207 can be positioned a suitable distance from the transmitter coil 203, however they are preferably suited such that they ensure adequate receipt of the transmitted signal. An example of a suitable distance would from one to four floors up to down from the transmitter coils 203. In one embodiment, the receiver coils 207 are located 2 floors up or down from the transmitter coils 201. The distance between the coils, whether vertically, horizontally, or both can range from 3 m to 30 m, preferably from 10 m to 17 m.

The receiver 207 is essentially an electronic circuit capable of accepting the signal transmitted over the steel bar and converting it into a human-cognizable standard, for example, data, audio, visually, legible, etc. Examples of receivers include modems, audio receivers, box top converters, transducers, and the like. Prior to being delivered to the receiver 207 and after transmission to the coil 209, the signal may be passed through electronic circuitry designed to enhance or modify the signal, such as a filter.

As shown in FIG. 2, the reinforced steel bars 211 are utilized to transmit the signal throughout the building structure to various receivers. While not to be bound by theory, it is believed that when a signal is transmitted through steel bars 211, all the steel bars will form a multiplicity of parallel paths for conducting of magnetic flux 213. Thus, the building structure becomes a huge signal transformer and the signal can be received at any location of the building where the coils are installed.

Figure 3:
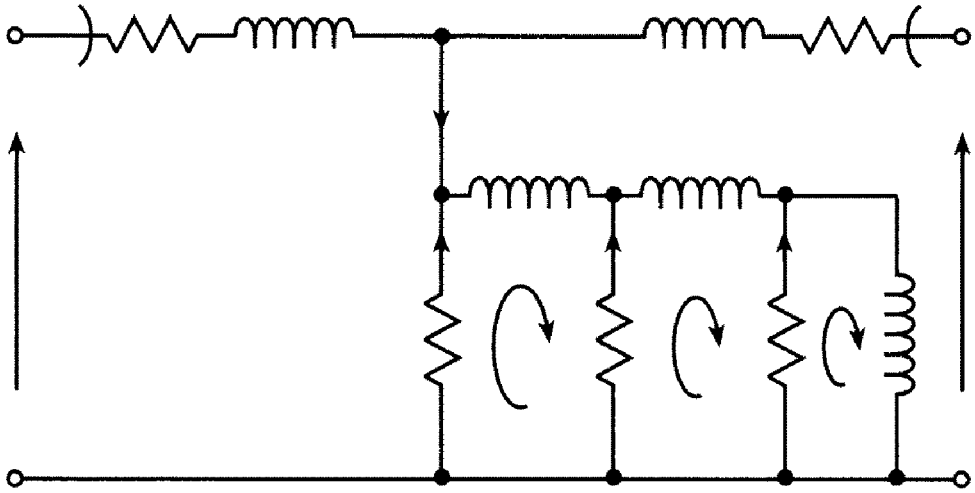
FIG. 3 shows a schematic example of a system of the present invention.

FIG. 3 shows an equivalent circuit of the typical transformer. The equivalent circuit shows the transmission of the signal through resistors, thus generating a magnetic flux through the system. The circuit can be represented by the equations $$V_p=I_pR_p+N_p(d\Phi_{1p}/dt)+N_p(d\Phi_m/dt)$$

$$V_s=-I_sR_s+N_s(d\Phi_{1s}/dt)+N_s(d\Phi_m/dt)$$

where $\Phi_m$ is the mutual flux in the steel bar, $\Phi_{1p}$ and $\Phi_{1s}$ are the leakage fluxes of the transmitter coil and receiver coil, and $R_p$ and $R_s$ are the resistance of the transmitter coil and receiver coil, respectively.

EXAMPLE

A transmitter and several receivers are installed in a 9 story building. The transmitter and various receivers were installed on different floors. The transmitter ("A") plus coil with winding 200 turns was installed on the reinforced steel bars on the $3^{rd}$ floor. One receiver ("B") plus coil with winding 200 turns was installed on the steel bars on the $4^{th}$ floor. Another receiver ("C") plus coil with winding 200 turns was installed on the steel bars on the $7^{th}$ floor. A third receiver ("R") plus coil with winding 200 turns was installed on the steel bars on the roof. The transmitter and receivers were installed by casting in the concrete of a wall on their assigned floor, locating the steel bar frame and attaching a coil thereto.

"A" Coil to "B" Coil

FIGS. 4(*a*) and 4(*b*) show the results of signal transmission and receipt by the transmitter ("A") and receiver "B" ($4^{th}$ floor). A short distance performance was made between "A" and "B" in order to determine whether the signal can use the steel bars to transmit signals within a short distance. The coils of "A" were installed through a diameter 10 mm horizontal steel bar which was lapped and tied together with some vertical steel bars on the wall in between 3/F & 4/F. The coils of "B" was installed through a diameter 10 mm vertical steel bar on the wall at 4/F. The distance between the two coils was about 3 m.

A test signal was set to "A" Coil. The signal was transformed to magnetic flux and flowed through all the reinforced steel bars of the building. The magnetic flux linked to "B" Coil, and the signal was measured by a spectrum analyzer. Measurements were made between 5 MHz to 25 MHz, and 10 MHz to 100 MHz.

FIGS. 4(*a*) and 4(*b*) show very good signal transmission and receipt. The attenuation was just around −30 dB at the lower frequency band below 25 MHz with lowest point of −25 dB at 9 MHz and second lowest point of −27 dB at 13 MHz. The system was further attenuated to −60 dB while the frequency was increasing up to 50 MHz in higher frequency band.

"A" Coil to "C" Coil

FIGS. 5(*a*) and 5(*b*) show the results of signal transmission between the $3^{rd}$ and $7^{th}$ floor.

"A" Coil was connected as before. "C" Coil was installed through a diameter 10 mm vertical steel bar on the $7^{th}$ floor. The distance between "A" Coil and "C" Coil was about 14 m. For such a distance, the magnetic flux from "A" Coil to "C" Coil should pass through a number of cross points of different steel bar on each floor and subdivision of the total flux into a multiplicity of parallel paths from "A" Coil to "C" Coil.

FIG. 5(*a*) shows the shape of lower frequency response to be almost the same as that for FIGS. 4(*a*) and (*b*) with peaks located of 9 MHz, 13.5 MHz, 18 MHz and 21.5 MHz. However, FIG. 5(*b*) shows a higher frequency response to be better than FIGS. 4(*a*) and 4(*b*). Additionally, the best performance point was shifted to 13.5 MHz with −20.5 dB in comparison with −25 dB at 9 MHz FIG. 4(*a*). The performance in larger distance of "A" Coil to "C" Coil was better than the shorter distance of "A" Coil to "B" Coil. This may be due to the different workmanship and lapping of the steel bars on different floors. Furthermore, at the higher frequency range, the attenuation was also improved to around −40 dB is between 55 to 70 MHz in comparison with −60 dB in "A" Coil to "B" Coil.

"A" Coil to "R" Coil

"A" Coil was installed as before. "R" Coil was installed through a diameter 10 mm horizontal steel bars at the most remote location in the parapet wall at the roof floor, where the wall was a non-structural element and had less steel bar lapping with other main steel bars in comparison with other locations. In this system, the magnetic flux reluctance was comparatively higher than others and less magnetic flux passed through "R" Coils. The distance between "A" Coil and "R" Coil was about 30 m. The magnetic flux from "A" Coil and "R" Coil is believed to pass through a number of cross points of different reinforced steel bars in different floor/slab/beam and subdivision of the total flux into a multiplicity of parallel paths "A" Coil to "R" Coil. Most of the flux from "A" Coil would not link to "R" Coil directly because of the remote area and parapet will structure.

FIGS. 6(*a*) and 6(*b*) show the results of transmission from "A" Coil to "R" Coil. As shown, the shape of frequency response was different with all the previous measured results in both low and frequency bound. The peak of response was −30 dB at 13 MHz in FIG. 6(*a*), which is the same as the peak frequency response of "A" Coil to "B" Coil and "A" Coil to "C" Coil, but the attenuation was different. In the higher frequency response of FIG. 6(*b*), the attenuation was very high around −60 dB at the frequency above 25 MHz.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A method of transmitting signals in a reinforced concrete building comprising the steps of installing a transmitter and a transmitter coil to a reinforced steel bar;

installing a receiver and a receiver coil to a reinforced steel bar at any locations of the building;

sending a signal to said transmitter;

transmitting said signal from said transmitter to said receiver coil; and collecting said signal by said receiver.

2. The method of claim 1, wherein said receiver coil and transmitter coil is installed at any locations of a reinforced concrete building.

3. The method of claim 2, wherein said signal is a data, video, telephone, SMATV, security and broadband network signal.

4. The method of claim 1, wherein transmitting said signal is via magnetic flux.

5. A system for transmitting a signal in reinforced steel bars of a building comprising a transmitter;

a transmitter coil;

a receiver;

a receiver coil; and a reinforced steel bar structure.

6. The system for transmitting a signal in a building in claim 5, wherein said transmitter coil is comprised of a number of turns.

7. The system for transmitting a signal in a building in claim 5, wherein said receiver coil is comprised of a number of turns.

8. The system for transmitting a signal in a building in claim 5, wherein the steel bars in said reinforced steel bar structure is a structural element or non-structural element of the building.

9. The system for transmitting a signal in a building in claim 5, wherein said receiver coil is positioned at any distance from said transmitter coil within a building.

* * * * *